US008308878B2

(12) United States Patent
Oishi et al.

(10) Patent No.: US 8,308,878 B2
(45) Date of Patent: Nov. 13, 2012

(54) MAGNESIUM-BASED ALLOY WIRE AND METHOD OF ITS MANUFACTURE

(75) Inventors: Yukihiro Oishi, Itami (JP); Nozomu Kawabe, Itami (JP)

(73) Assignees: Sumitomo Electric Industries, Ltd., Osaka (JP); Sumitomo (SEI) Steel Wire Corp., Osaka (JP)

( * ) Notice: Subject to any disclaimer, the term of this patent is extended or adjusted under 35 U.S.C. 154(b) by 1886 days.

(21) Appl. No.: 10/479,433

(22) PCT Filed: May 16, 2002

(86) PCT No.: PCT/JP02/04759
§ 371 (c)(1),
(2), (4) Date: Nov. 29, 2003

(87) PCT Pub. No.: WO02/099148
PCT Pub. Date: Dec. 12, 2002

(65) Prior Publication Data

US 2004/0163744 A1 Aug. 26, 2004

(30) Foreign Application Priority Data

| | | |
|---|---|---|
| Jun. 5, 2001 | (JP) | 2001-170161 |
| Sep. 20, 2001 | (JP) | 2001-287806 |
| Dec. 27, 2001 | (JP) | 2001-398168 |
| Feb. 4, 2002 | (JP) | 2002-027310 |
| Feb. 4, 2002 | (JP) | 2002-027376 |
| Mar. 28, 2002 | (JP) | 2002-092965 |

(51) Int. Cl.
*C22C 23/00* (2006.01)

(52) U.S. Cl. ..... 148/667; 148/420; 420/408; 420/409; 420/410

(58) Field of Classification Search ..... 148/667, 148/420; 420/408, 409, 410
See application file for complete search history.

(56) References Cited

U.S. PATENT DOCUMENTS 2,149,436 A 3/1939 Hadenfeldt et al.

(Continued)

FOREIGN PATENT DOCUMENTS

CN 1119679 A 4/1996

(Continued)

OTHER PUBLICATIONS

Wallace, J.J. and Ring, Jr. F., Surface finish specifications, contract No. W-7405, eng.26, Oak Ridge National Laboratory, Oak Ridge, Tennessee, Jul. 24, 1951, pp. 1-13.*

(Continued)

*Primary Examiner* — Sikyin Ip
(74) *Attorney, Agent, or Firm* — James W. Judge

(57) ABSTRACT

Magnesium-based alloy wire excelling in strength and toughness, its method of manufacture, and springs in which the magnesium-based alloy wire is utilized are made available. The magnesium-based alloy wire contains, in mass %, 0.1 to 12.0% Al, and 0.1 to 1.0% Mn, and is provided with the following constitution. Diameter d that is 0.1 mm or more and 10.0 mm or less; length L that is 1000 d or more; tensile strength that is 250 MPa or more; necking-down rate that is 15% or more; and elongation that is 6% or more. Such wire is produced by draw-forming it at a working temperature of 50° C. or more, and by heating it to a temperature of 100° C. or more and 300° C. or less after the drawing process has been performed.

1 Claim, 1 Drawing Sheet

10 μm

U.S. PATENT DOCUMENTS

| | | | | |
|---|---|---|---|---|
| 2,396,218 | A | 3/1946 | Watters | |
| 2,750,311 | A | 6/1956 | Snyder et al. | |
| 4,990,198 | A * | 2/1991 | Masumoto et al. | 148/403 |
| 4,997,622 | A * | 3/1991 | Regazzoni et al. | 420/407 |

FOREIGN PATENT DOCUMENTS

| | | | |
|---|---|---|---|
| DE | 630061 | C | 5/1936 |
| GB | 450226 | A | 7/1936 |
| JP | S59-004497 | B2 | 1/1984 |
| JP | A63-030990 | B2 | 6/1988 |
| JP | S63-030390 | B2 | 6/1988 |
| JP | S63-282232 | A | 11/1988 |
| JP | H03-087339 | A | 4/1991 |
| JP | H07-003375 | A | 1/1995 |
| JP | 09-279286 | A | 10/1997 |
| JP | 2000-160407 | A | 6/2000 |
| JP | 2001-140049 | A | 5/2001 |
| JP | 2001-269746 | A | 10/2001 |

OTHER PUBLICATIONS

Korenevskii, E. Ya. and Yatsenko, V.K., Effect of main machining operations on the surface finish and fatigue life of compressor blades made from 1Kh17N2 steel, Strength of Materials, vol. 3, No. 3, 257-262, Mar. 1971.*

Kerlins, V., Modes of fracture, ASM Handbook, Fractography, vol. 12, 1987.*

Scutti, J. J., Failures related to metalworking, ASM Handbook, Failure Analysis and Prevention, vol. 11, 2002.*

Zeng Xiaoqin, et al., "Quality Control for Magnesium Alloy Ingots," Special Casting and Non-Ferrous Alloy, Supplement, 2000, pp. 40-42, vol. 1.

Xu Riyao, et al., "The Activity and Production of Magnesium-Based Alloy," Light Metal, 1999, 47-49, vol. 4.

A. Bag and W. Zhou., "Tensile and fatigue behavior of AZ91D magnesium alloy," Journal of Materials Science Letters, 20, 2001, pp. 457-459.

Toshinori Ohshima et al., "Specificity in the Fatigue Properties of Hot Extruded Magnesium Alloys," Symposium of Presentations at the 72nd National Convention of the Japan Society of Mechanical Engineers, (I), pp. 35-37.

Ryouhei Uchida et al., "Fatigue properties of thixomolded heat resistant magnesium alloys," Summary of Presentations at the 99th Autumn Convention of the Japan Institute of Light Metals (2000), pp. 73-74.

* cited by examiner

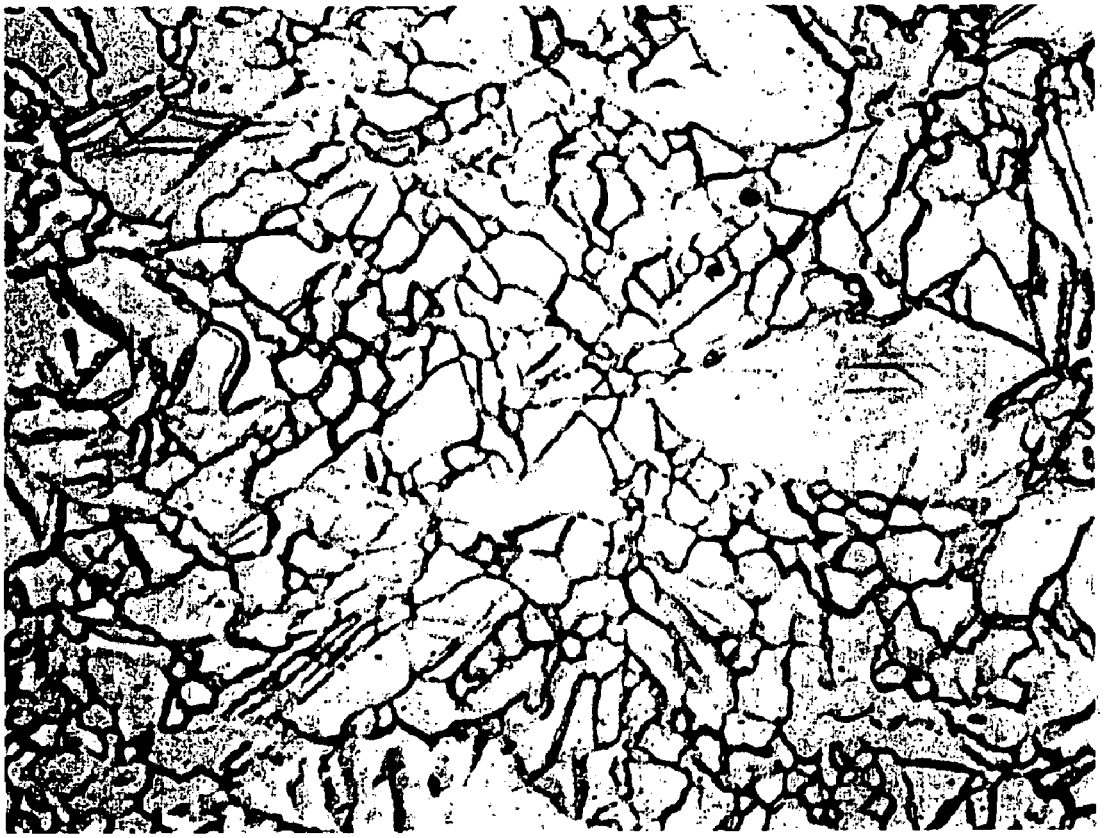
10 μm

MAGNESIUM-BASED ALLOY WIRE AND METHOD OF ITS MANUFACTURE

TECHNICAL FIELD

The present invention relates to magnesium-based alloy wire of high toughness, and to methods of manufacturing such wire. The invention further relates to springs in which the magnesium-based alloy wire is utilized.

BACKGROUND ART

Magnesium-based alloys, which are lighter than aluminum, and whose specific strength and relative stiffness are superior to steel and aluminum, are employed widely in aircraft parts, in automotive parts, and in the bodies for electronic goods of all sorts.

Nevertheless, the ductility of Mg and alloys thereof is inadequate, and their plastic workability is extremely poor, owing to their hexagonal close-packed crystalline structure. This is why it has been exceedingly difficult to produce wire from Mg and its alloys.

What is more, although circular rods can be produced by hot-rolling and hot-pressing an Mg/Mg alloy casting material, since they lack toughness and their necking-down (reduction in cross-sectional area) rate is less than 15% they have not been suited to, for example, cold-working to make springs. In applications where magnesium-based alloys are used as structural materials, moreover, their YP (tensile yield point) ratio (defined herein as 0.2% proof stress [i.e., offset yield strength]/tensile strength) and torsion yield ratio $\tau_{0.2}/\tau_{max}$ (ratio of 0.2% offset strength $\tau_{0.2}$ to maximum shear stress $\tau_{max}$ in a torsion test) are inferior compared with general structural materials.

Meanwhile, high-strength Mg—Zn—X system (X:Y, Ce, Nd, Pr, Sm, Mm) magnesium-based alloys are disclosed in Japanese Pat. App. Pub. No. H07-3375, and produce strengths of 600 MPa to 726 MPa. The published patent application also discloses carrying out a bend-and-flatten test to evaluate the toughness of the alloys.

The forms of the materials obtained therein nevertheless do not go beyond short, 6-mm diameter, 270-mm length rods, and lengthier wire cannot be produced by the method described (powder extrusion). And because they include addition elements such as Y, La, Ce, Nd, Pr, Sm, Mm on the order of several atomic %, the materials are not only high in cost, but also inferior in recyclability.

In the *Journal of Materials Science Letters,* 20, 2001, pp. 457-459, furthermore, the fatigue strength in an AZ91 alloy casting material is described, and being on the approximately 20 MPa level, is extremely low.

In *Symposium of Presentations at the* 72$^{nd}$ *National Convention of the Japan Society of Mechanical Engineers*, (1), pp. 35-37, results of a rotating-bending fatigue test on material extruded from AZ21 alloy are described, and indicate a fatigue strength of 100 MPa, although the evaluation is not up to $10^7$ cycles. In *Summary of Presentations at the* 99$^{th}$ *Autumn Convention of the Japan Institute of Light Metals* (2000), pp. 73-74, furthermore, rotating-bending fatigue characteristics of materials formed by thixomolding™ AE40, AM60 and ACaSr6350p are described. The fatigue strengths at room temperature are respectively 65 MPa, 90 MPa and 100 MPa, however. In short, as far as rotating-bending fatigue strength of magnesium-based alloys is concerned, fatigue strengths over 100 MPa have not been obtained.

DISCLOSURE OF INVENTION

A chief object of the present invention is in realizing magnesium-based alloy wire excelling in strength and toughness, in realizing a method of its manufacture, and in realizing springs in which the magnesium-based alloy wire is utilized.

Another object of the present invention is in also realizing magnesium-based alloy wire whose YP ratio and $\tau_{0.2}/\tau_{max}$ ratio are high, and in realizing a method of its manufacture.

A separate object of the present invention is further in realizing magnesium-based alloy wire having a high fatigue strength that exceeds 100 MPa, and in realizing a method of its manufacture.

As a result of various studies made on the ordinarily difficult process of drawing magnesium-based alloys the present inventors discovered, and thereby came to complete the present invention, that by specifying the processing temperature during the drawing process, and as needed combing the drawing process with a predetermined heating treatment, wire excelling in strength and toughness could be produced.

(Magnesium-Based Alloy Wire)

A first characteristic of magnesium-based alloy wire according to the present invention is that it is magnesium-based alloy wire composed of any of the chemical components in (A) through (E) listed below, wherein its diameter d is rendered to be 0.1 mm or more but 10.0 mm or less, its length L to be 1000 d or more, its tensile strength to be 220 MPa or more, its necking-down rate to be 15% or more, and its elongation to be 6% or more.

(A) Magnesium-based alloys containing, in mass %: 2.0 to 12.0% Al, and 0.1 to 1.0% Mn.

(B) Magnesium-based alloys containing, in mass %: 2.0 to 12.0% Al, and 0.1 to 1.0% Mn; and furthermore containing one or more elements selected from 0.5 to 2.0% Zn, and 0.3 to 2.0% Si.

(C) Magnesium-based alloys containing, in mass %: 1.0 to 10.0% Zn, and 0.4 to 2.0% Zr.

(D) Magnesium-based alloys containing, in mass %: 1.0 to 10.0% Zn, and 0.4 to 2.0% Zr; and furthermore containing 0.5 to 2.0% Mn.

(E) Magnesium-based alloys containing, in mass %.: 1.0 to 10.0% Zn, and 1.0 to 3.0% rare-earth element(s).

Either magnesium-based casting alloys or magnesium-based wrought alloys can be used for the magnesium-based alloy utilized in the wire. To be more specific, AM series, AZ series, AS series, ZK series, EZ series, etc. in the ASTM specification can for example be employed. Employing these as alloys containing, in addition to the chemical components listed above, Mg and impurities is the general practice. Such impurities may be, to name examples, Fe, Si, Cu, Ni, and Ca.

AM60 in the AM series is a magnesium-based alloy that contains: 5.5 to 6.5% Al; 0.22% or less Zn; 0.35% or less Cu; 0.13% or more Mn; 0.03% or less Ni; and 0.5% or less Si. AM100 is a magnesium-based alloy that contains: 9.3 to 10.7% Al; 0.3% or less Zn; 0.1% or less Cu; 0.1 to 0.35% Mn; 0.01% or less Ni; and 0.3% or less Si.

AZ10 in the AZ series is a magnesium-based alloy that contains, in mass %: 1.0 to 1.5% Al; 0.2 to 0.6% Zn; 0.2% or more Mn; 0.1% or less Cu; 0.1% or less Si; and 0.4% or less Ca. AZ21 is a magnesium-based alloy that contains, in mass %: 1.4 to 2.6% Al; 0.5 to 1.5% Zn; 0.15 to 0.35% Mn; 0.03% or less Ni; and 0.1% or less Si. AZ31 is a magnesium-based alloy that contains: 2.5 to 3.5% Al; 0.5 to 1.5% Zn; 0.15 to 0.5% Mn; 0.05% or less Cu; 0.1% or less Si; and 0.04% or less Ca. AZ61 is a magnesium-based alloy that contains: 5.5 to 7.2% Al; 0.4 to 1.5% Zn; 0.15 to 0.35% Mn; 0.05% or less Ni; and 0.1% or less Si. AZ91 is a magnesium-based alloy that contains: 8.1 to 9.7% Al; 0.35 to 1.0% Zn; 0.13% or more Mn; 0.1% or less Cu; 0.03% or less Ni; and 0.5% or less Si.

AS21 in the AS series is a magnesium-based alloy that contains, in mass %: 1.4 to 2.6% Al; 0.1% or less Zn; 0.15% or less Cu; 0.35 to 0.60% Mn; 0.001% Ni; and 0.6 to 1.4% Si. AS41 is a magnesium-based alloy that contains: 3.7 to 4.8% Al; 0.1% or less Zn; 0.15% or less Cu; 0.35 to 0.60% Mn; 0.001% or less Ni; and 0.6 to 1.4% Si.

ZK60 in the ZK series is a magnesium-based alloy that contains 4.8 to 6.2% Zn, and 0.4% or more Zr.

EZ33 in the EZ series is a magnesium-based alloy that contains: 2.0 to 3.1% Zn; 0.1% or less Cu; 0.01% or less Ni; 2.5 to 4.0% RE; and 0.5 to 1% Zr. "RE" herein is a rare-earth element(s); ordinarily, it is common to employ a mixture of Pr and Nd.

Although obtaining sufficient strength simply from magnesium itself is difficult, desired strength can be gained by including the chemical components listed above. Moreover, a manufacturing method to be described later enables wire of superior toughness to be produced.

Then imparting to the alloy the tensile strength, necking-down rate, and elongation stated above serves to lend it both strength and toughness, and facilitates later processes such as working the alloy into springs. A more preferable tensile strength is, with the AM series, AZ series, AS series and ZK series, 250 MPa or more; more preferable still is 300 MPa or more; and especially preferable is 330 MPa or more. A more preferable tensile strength with the EZ series is 250 MPa or more.

Likewise, a more preferable necking-down rate is 30% or more; particularly preferable is 40% or more. The AZ31 chemical components are especially suited to achieving a necking-down rate of 40% or greater. Also, in that a magnesium-based alloy containing 0.1 to less than 2.0% Al, and 0.1 to 1.0% Mn achieves a necking-down rate of 30% or more, the chemical components are preferable. A more preferable necking-down rate for a magnesium-based alloy containing 0.1 to less than 2.0% Al, and 0.1 to 1.0% Mn is 40% or more; and a particularly preferable necking-down rate is 45% or more. Then a more preferable elongation is 10% or more; a tensile strength, 280 MPa or more.

A second characteristic of magnesium-based alloy wire in the present invention is that it is magnesium-based alloy wire of the chemical components noted earlier, wherein its YP ratio is rendered to be 0.75 or more.

The YP ratio is a ratio given as "0.2% proof stress/tensile strength." The magnesium-based alloy desirably is of high strength in applications where it is used as a structural material. In such cases, because the actual working limit is determined not by the tensile strength, but by the size of the 0.2% proof stress, in order to obtain high strength in a magnesium-based alloy, not only the absolute value of the tensile strength has to be raised, but the YP ratio has to be made greater also. Conventionally round rods have been produced by hot-extruding a wrought material such as AZ10 alloy or AZ21 alloy, but their tensile strength is 200 to 240 MPa, and their YP ratio (0.2% proof stress/tensile strength) is 0.5 to less than 0.75%. With the present invention, by specifying for the drawing process the processing temperature, the speed with which the temperature is elevated to the working temperature, the formability, and the wire speed; and after the drawing process, by subjecting the material to a predetermined heating treatment, magnesium-based alloy wire whose YP ratio is 0.75 or more can be produced.

For example, magnesium-based alloy wire whose YP ratio is 0.90 or more can be produced by carrying out the drawing process at: 1° C./sec to 100° C./sec temperature elevation speed to working temperature; 50° C. or more but 200° C. or less (more preferably 150° C. or less) working temperature; 10% or more formability; and 1 m/min or more wire speed. In addition, by cooling the wire after the foregoing drawing process, and heat-treating it at 150° C. or more but 300° C. or less temperature, for 5 min or more holding time, magnesium-based alloy wire whose YP ratio is 0.75 or more but less than 0.90 can be produced. Although larger YP ratio means superior strength, because it would mean inferior workability in situations where subsequent processing is necessary, magnesium-based alloy wire whose YP ratio is 0.75 or more but less than 0.90 is practicable when manufacturability is taken into consideration. The YP ratio preferably is 0.80 or more but less than 0.90

A third characteristic of magnesium-based alloy wire in the present invention is that it is magnesium-based alloy wire of the chemical components noted earlier, wherein the ratio $\tau_{0.2}/\tau_{max}$ of its 0.2% offset strength $\tau_{0.2}$ to its maximum shear stress $\tau_{max}$ in a torsion test is rendered to be 0.50 or more.

With regard to uses, such as in coil springs, in which torsion characteristics are influential, it becomes crucial that not only the YP ratio when tensioning, but also the torsion yield ratio—i.e. $\tau_{0.2}/\tau_{max}$—be large. The drawing process time, process temperature, temperature elevation speed to working temperature, formability, and wire speed are specified by the present invention; and after the drawing process, by subjecting the material to a predetermined heating treatment, magnesium-based alloy wire whose $\tau_{0.2}/\tau_{max}$ is 0.50 or more can be produced.

For example, magnesium-based alloy wire whose $\tau_{0.2}/\tau_{max}$ is 0.60 or more can be produced by carrying out the drawing process at: 1° C./sec to 100° C./sec temperature elevation speed to working temperature; 50° C. or more but 200° C. or less (more preferably 150° C. or less) working temperature; 10% or more formability; and 1 m/min or more wire speed. In addition, by cooling the wire after the foregoing drawing process, and then heat-treating it at 150° C. or more but 300° C. or less temperature, for 5 min or more holding time, magnesium-based alloy wire whose $\tau_{0.2}/\tau_{max}$ is 0.50 or more but less than 0.60 can be produced.

A fourth characteristic of magnesium-based alloy wire in the present invention is that it is magnesium-based alloy wire of the chemical components noted earlier, wherein the average crystal grain size of the alloy constituting the wire is rendered to be 10 μm or less.

Refining the average crystal grain size of the magnesium-based alloy to render magnesium-based alloy wire whose strength and toughness are balanced facilitates later processes such as spring-forming. Control over the average crystal grain size is carried out principally by adjusting the working temperature during the drawing process.

More particularly, rendering the alloy microstructure to have an average crystal grain size of 5 μm or less makes it possible to produce magnesium-based alloy wire in which strength and toughness are balanced all the more. A fine crystalline structure in which the average crystal grain size is 5 μm or less can be obtained by heat-treating the post-extruded material at 200° C. or more but 300° C. or less, more preferably at 250° C. or more but 300° C. or less. A fine crystalline structure in which the average crystal grain size is 4 μm or less, moreover, can improve the fatigue characteristics of the alloy.

A fifth characteristic of magnesium-based alloy wire in the present invention is that it is magnesium-based alloy wire of the chemical components noted earlier, wherein the size of the crystal grains of the alloy constituting the wire is rendered to be fine crystal grains and coarse crystal grains in a mixed-grain structure.

Rendering the crystal grains into a mixed-grain structure makes it possible to produce magnesium-based alloy wire that is lent both strength and toughness. The mixed-grain structure may be, to cite a specific example, a structure in which fine crystal grains having an average crystal grain size of 3 μm or less and coarse crystal grains having an average crystal grain size of 15 μm or more are mixed. Especially making the surface-area percentage of crystal grains having an average crystal grain size of 3 μm or less 10% or more of the whole makes it possible to produce magnesium-based alloy wire excelling all the more in strength and toughness. A mixed-grain structure of this sort can be obtained by the combination of a later-described drawing and heat-treating processes. One particularity therein is that the heating process is preferably carried out at 100 to 200° C.

A sixth characteristic of magnesium-based alloy wire in the present invention is that it is magnesium-based alloy wire of the chemical components noted earlier, wherein the surface roughness of the alloy constituting the wire is rendered to be $R_z \leqq 10$ μm.

Producing magnesium-based alloy wire whose outer surface is smooth facilitates spring-forming work utilizing the wire. Control over the surface roughness is carried out principally by adjusting the working temperature during the drawing process. Other than that, the surface roughness is also influenced by the wiredrawing conditions, such as the drawing speed and the selection of lubricant.

A seventh characteristic of magnesium-based alloy wire in the present invention is that it is magnesium-based alloy wire of the chemical components noted earlier, wherein the axial residual stress in the wire surface is made to be 80 MPa or less.

With the (tensile) residual stress in the wire surface in the axial direction being 80 MPa or less, sufficient machining precision in later-stage reshaping or machining processes can be secured. The axial residual stress can be adjusted by factors such as the drawing process conditions (temperature, formability), as well as by the subsequent heat-treating conditions (temperature, time). Especially having the axial residual stress in the wire surface be 10 MPa or less makes it possible to produce magnesium-based alloy wire excelling in fatigue characteristics.

An eighth characteristic of magnesium-based alloy wire in the present invention is that it is magnesium-based alloy wire of the chemical components noted earlier, wherein the fatigue strength when a repeat push-pull stress amplitude is applied $1\times10^7$ times is made to be 105 MPa or more.

Producing magnesium-based alloy wire lent fatigue characteristics as just noted enables magnesium-based alloy to be employed in a wide range of applications demanding advanced fatigue characteristics, such as in springs, reinforcing frames for portable household electronic goods, and screws. Magnesium-based alloy wire imparted with such fatigue characteristics can be obtained by giving the material a 150° C. to 250° C. heating treatment following the drawing process.

A ninth characteristic of magnesium-based alloy wire in the present invention is that it is magnesium-based alloy wire of the chemical components noted earlier, wherein the out-of-round of the wire is made to be 0.01 mm or less. The out-of-round is the difference between the maximum and minimum values of the diameter in the same sectional plane through the wire. Having the out-of-round be 0.01 mm or less facilitates using the wire in automatic welding machines. What is more, rendering wire for springs to have an out-of-round of 0.01 mm or less enables stabilized spring-forming work, thereby stabilizing spring characteristics.

A tenth characteristic of magnesium-based alloy wire in the present invention is that it is magnesium-based alloy wire of the chemical components noted earlier, wherein the wire is made to be non-circular in cross-sectional form.

Wire is most generally round in cross-sectional form. Nevertheless, with the present-invention wire, which excels also in toughness, wire is not limited to round form and can readily be made to have odd elliptical and rectangular/polygonal forms in cross section. Making the cross-sectional form of wire be non-circular is readily handled by altering the form of the drawing die. Odd form wire of this sort is suited to applications in eyeglass frames, in frame-reinforcement materials for portable electronic devices, etc.

(Magnesium-Based-Alloy Welding Wire)

The foregoing wire can be employed as welding wire. In particular, it is ideally suited to use in automatic welding machines where welding wire wound onto a reel is drawn out. For the welding wire, rendering the chemical components an AM-series, AZ-series, AS-series, or ZK-series magnesium alloy filament—especially the (A) through (C) chemical components noted earlier—is suitable. In addition, the wire preferably is 0.8 to 4.0 mm in diameter. It is furthermore desirable that the tensile strength be 330 MPa or more. By making the wire have a diameter and tensile strength as just given, as welding wire it can be reeled onto and drawn out from the reel without a hitch.

(Magnesium-Based-Alloy Springs)

Magnesium-based alloy springs in the present invention are characterized in being the spring-forming of the foregoing magnesium-based alloy wire.

Thanks to the above-described magnesium-based alloy wire being lent strength on the one hand, and at the same time toughness on the other, it may be worked into springs without hindrances of any kind. The wire lends itself especially to cold-working spring formation.

(Method of Manufacturing Magnesium-Based-Alloy Wire)

A method of manufacturing magnesium-based alloy wire in the present invention is then characterized in rendering a step of preparing magnesium-based alloy as a raw-material parent metal composed of any of the chemical components in (A) through (E) noted earlier, and a step of drawing the raw-material parent metal to work it into wire form.

The method according to the present invention facilitates later work such as spring-forming processes, making possible the production of wire finding effective uses as reinforcing frames for portable household electronic goods, lengthy welders, and screws, among other applications. The method especially allows wire having a length that is 1000 times or more its diameter to be readily manufactured.

Bulk materials and rod materials procured by casting, extrusion, or the like can be employed for the raw-material parent metal. The drawing process is carried out by passing the raw-material parent metal through, e.g., a wire die or roller dies. As to the drawing process, the work is preferably carried out with the working temperature being 50° C. or above, more preferably 100° C. or above. Having the working temperature be 50° C. or more facilitates the wire work. However, because higher processing temperatures invite deterioration in strength, the working temperature is preferably 300° C. or less. More preferably, the working temperature is 200° C. or less; more preferably still the working temperature is 150° C. or less. In the present invention a heater is set up in front of the dies, and the heating temperature of the heater is taken to be working temperature.

It is preferable that the speed temperature is elevated to the working temperature be 1° C./sec to 100° C./sec. Likewise, the wire speed in the drawing process is suitably 1 m/min or more.

The drawing process may also be carried out in multiple stages by plural utilization of wire dies and roller dies. Finerdiameter wire may be produced by this repeat multipass drawing process. In particular, wire less than 6 mm in diameter may be readily obtained.

The percent cross-sectional reduction in one cycle of the drawing process is preferably 10% or more. Owing to the fact that with low formability the yielded strength is low, by carrying the process out at a percent cross-sectional reduction of 10% or more, wire of suitable strength and toughness can be readily produced. More preferable is a cross-sectional percent reduction per-pass of 20% or more. Nevertheless, because the process would be no longer practicable if the formability is too large, the upper limit on the per-pass cross-sectional percent reduction is some 30% or less.

Also favorable to the drawing process is that the total cross-sectional percent reduction therein be 15% or more. The total cross-sectional percent reduction more preferably is 25% or more. The combination of a drawing process with a total cross-sectional percent reduction along these lines, and a heat treating process as will be described later, makes it possible to produce wire imparted with both strength and toughness, and in which the metal is lent a mixed-grain or finely crystallized structure.

Turning now to post-drawing aspects of the present method, the cooling speed is preferably 0.1° C./sec or more. Growth of crystal grains sets in if this lower limit is not met. The cooling means may be, to name an example, air blasting, in which case the cooling speed can be adjusted by the air-blasting speed, volume, etc.

After the drawing process, furthermore, the toughness of the wire can be enhanced by heating it to 100° C. or more but 300° C. or less. The heating temperature more preferably is 150° C. or more but 300° C. or less. The duration for which the heating temperature is held is preferably some 5 to 20 minutes. This heating (annealing) promotes in the wire recovery from distortions introduced by the drawing process, as well as its recrystallization. In cases where after the drawing process annealing is carried out, the drawing process temperature may be less than 50° C. Putting the drawing process temperature at the 30° C.-plus level makes the drawing work itself possible, while performing subsequent annealing enables the toughness to be significantly improved.

In particular, carrying out post-drawing annealing is especially suited to producing magnesium-based alloy wire lent at least one among characteristics being that the elongation is 12% or more, the necking-down rate is 40% or more, the YP ratio is 0.75 or more but less than 0.90, and the $\tau_{0.2}/\tau_{max}$ is 0.50 or more but less than 0.60.

In a further aspect, carrying out a 150 to 250° C. heat-treating process after the drawing work is especially suited to producing (1) magnesium-based alloy wire whose fatigue strength when subjected $1\times10^7$ times to a repeat push-pull stress amplitude is 105 MPa or more; (2) magnesium-based alloy wire wherein the axial residual stress in the wire surface is made to be 10 MPa or less; and (3) magnesium-based alloy wire whose average crystal grain size is 4 μm or less.

BRIEF DESCRIPTION OF DRAWING

FIG. 1 is an optical micrograph of the structure of wire by the present invention.

BEST MODE FOR CARRYING OUT THE INVENTION

Embodiments of the present invention will be explained in the following.

Embodiment 1

Wire was fabricated utilizing as a ϕ 0 6.0 mm extrusion material a magnesium alloy (a material corresponding to ASTM specification AZ-31 alloy) containing, in mass %, 3.0% Al, 1.0% Zn and 0.15% Mn, with the remainder being composed of Mg and impurities, by drawing the extrusion material through a wire die under a variety of conditions. The heating temperature of a heater set up in front of the wire die was taken to be the working temperature. The speed with which the temperature was elevated to the working temperature was 1 to 10° C./sec, and the wire speed in the drawing process was 2 m/min. Furthermore, a post-drawing cooling process was carried out by air-blast cooling. The average crystal grain size was found by magnifying the wire cross-sectional structure under a microscope, measuring the grain size of a number of the crystals within the field of view, and averaging the sizes. The post-processing wire diameter was 4.84 to 5.85 mm (5.4 mm in a 19% cross-sectional reduction process; 5.85 to 4.84 mm at 5 to 35% cross-sectional reduction rates). In Table I, the characteristics of wire obtained wherein the working temperature was varied are set forth, while in Table II, the characteristics of wire obtained wherein the cross-sectional reduction rate was varied are.

TABLE I

| Alloy type | | Working temp. ° C. | Cross-sectional reduction rate % | Cooling speed ° C./sec | Tensile strength MPa | Elongation after failure % | Necking-down rate % | Crystal grain size μm |
|---|---|---|---|---|---|---|---|---|
| AZ31 | Comp. | | Unprocessed | | 256 | 4.9 | 19.0 | 29.2 |
| | examples | 20 | 19 | 10 | | Unprocessable | | |
| | Present | 50 | 19 | 10 | 380 | 8.1 | 51.2 | 5.0 |
| | invention | 100 | 19 | 10 | 320 | 8.5 | 54.5 | 6.5 |
| | examples | 150 | 19 | 10 | 318 | 9.3 | 53.4 | 7.2 |
| | | 200 | 19 | 10 | 310 | 9.9 | 52.6 | 7.9 |
| | | 250 | 19 | 10 | 295 | 10.2 | 53.8 | 8.7 |
| | | 300 | 19 | 10 | 280 | 10.2 | 54.0 | 9.2 |
| | | 350 | 19 | 10 | 280 | 10.2 | 53.2 | 9.8 |

TABLE II

| Alloy type | | Working temp. ° C. | Cross-sectional reduction rate % | Cooling speed ° C./sec | Tensile strength MPa | Elongation after failure % | Necking-down rate % | Crystal grain size μm |
|---|---|---|---|---|---|---|---|---|
| AZ31 | Comp. | | Unprocessed | | 256 | 4.9 | 19.0 | 29.2 |
| | examples | 100 | 5 | 10 | 280 | 5.2 | 30.0 | 13.5 |
| | Present | 100 | 10.5 | 10 | 310 | 8.2 | 45.0 | 6.7 |
| | invention | 100 | 19 | 10 | 320 | 8.5 | 54.5 | 6.5 |
| | examples | 100 | 27 | 10 | 340 | 9.0 | 50.0 | 6.3 |
| | | 100 | 35 | | | Unprocessable | | |

As will be seen from Table I, the toughness of the extrusion material prior to the drawing process was: 19% necking-down rate, and 4.9% elongation. In contrast, the present invention examples, which went through drawing processes at temperatures of 50° C. or more, had necking-down rates of 50% or more and elongations of 8% or more. Their strength, moreover, exceeded that prior to the drawing process; and what with their strength being raised enhanced toughness was achieved.

In addition, with drawing-process temperatures of 250° C. or more, the rate of elevation in strength was small. It is accordingly apparent that an excellent balance between strength and toughness will be demonstrated with a working temperature of from 50° C. to 200° C. On the other hand, at a room temperature of 20° C. the drawing process was not workable, because the wire snapped.

As will be seen from Table II, with a formability of 5% as cross-sectional reduction rate, the necking-down and elongation percentages are together low, but when the formability was 10% or more, a necking-down rate of 40% or more and an elongation of 8% or more were obtained. Meanwhile, drawing was not possible with a formability of 35% as cross-sectional reduction rate. It is apparent from these facts that outstanding toughness will be demonstrated by means of a drawing process in which the formability is 10% or more but 30% or less.

The wires produced were of length 1000 times or more their diameter; and with the wires multipass, iterative processing was possible. Furthermore, the average crystal grain size of the present invention examples was in every case 10 μm or less, while the surface roughness $R_z$ was 10 μm or less. The axial residual stress in the wire surface, moreover, was found by X-ray diffraction, wherein for the present invention examples it was 80 MPa or less in every case.

Embodiment 2

Utilizing as a ϕ 6.0 mm extrusion material a magnesium alloy (a material corresponding to ASTM specification AZ-61 alloy) containing, in mass %, 6.4% Al, 1.0% Zn and 0.28% Mn, with the remainder being composed of Mg and impurities, a drawing process was conducted on the extrusion material by drawing it through a wire die under a variety of conditions. The heating temperature of a heater set up in front of the wire die was taken to be the working temperature. The speed with which the temperature was elevated to the working temperature was 1 to 10° C./sec, and the wire speed in the drawing process was 2 m/min. Furthermore, a post-drawing cooling process was carried out by air-blast cooling. The average crystal grain size was found by magnifying the wire cross-sectional structure under a microscope, measuring the grain size of a number of the crystals within the field of view, and averaging the sizes. The post-processing wire diameter was 4.84 to 5.85 mm (5.4 mm in a 19% cross-sectional reduction process; 5.85 to 4.84 mm at 5 to 35% cross-sectional reduction rates). In Table III, the characteristics of wire obtained wherein the working temperature was varied are set forth, while in Table IV, the characteristics of wire obtained wherein the cross-sectional reduction rate was varied are.

TABLE III

| Alloy type | | Working temp. ° C. | Cross-sectional reduction rate % | Cooling speed ° C./sec | Tensile strength MPa | Elongation after failure % | Necking-down rate % | Crystal grain size μm |
|---|---|---|---|---|---|---|---|---|
| AZ61 | Comp. | | Unprocessed | | 282 | 3.8 | 15.0 | 28.6 |
| | examples | 20 | 19 | 10 | | Unprocessable | | |
| | Present | 50 | 19 | 10 | 430 | 8.2 | 52.2 | 4.8 |
| | invention | 100 | 19 | 10 | 380 | 8.6 | 55.4 | 6.3 |
| | examples | 150 | 19 | 10 | 372 | 9.1 | 53.2 | 7.5 |
| | | 200 | 19 | 10 | 365 | 9.8 | 52.8 | 7.9 |
| | | 250 | 19 | 10 | 340 | 10.3 | 52.7 | 8.3 |
| | | 300 | 19 | 10 | 301 | 10.1 | 53.2 | 9.1 |
| | | 350 | 19 | 10 | 290 | 10.0 | 54.1 | 9.9 |

TABLE IV

| Alloy type | | Working temp. ° C. | Cross-sectional reduction rate % | Cooling speed ° C./sec | Tensile strength MPa | Elongation after failure % | Necking-down rate % | Crystal grain size μm |
|---|---|---|---|---|---|---|---|---|
| AZ61 | Comp. | | Unprocessed | | 282 | 3.8 | 15.0 | 28.6 |
| | examples | 100 | 5 | 10 | 302 | 4.9 | 28.0 | 13.1 |
| | Present | 100 | 10.5 | 10 | 350 | 8.3 | 44.3 | 6.5 |
| | invention | 100 | 19 | 10 | 380 | 8.8 | 55.4 | 6.3 |

TABLE IV-continued

| Alloy type | | Working temp. ° C. | Cross-sectional reduction rate % | Cooling speed ° C./sec | Tensile strength MPa | Elongation after failure % | Necking-down rate % | Crystal grain size μm |
|---|---|---|---|---|---|---|---|---|
| | examples | 100 | 27 | 10 | 430 | 8.9 | 49.9 | 6.2 |
| | | 100 | 35 | | | Unprocessable | | |

As will be seen from Table III, the toughness of the extrusion material prior to the drawing process was a low 15% necking-down rate, and 3.8% elongation. In contrast, the present invention examples, which went through drawing processes at temperatures of 50° C. or more, had necking-down rates of 50% or more and elongations of 8% or more. Their strength, moreover, exceeded that prior to the drawing process; and what with their strength being raised enhanced toughness was achieved.

In addition, with drawing-process temperatures of 250° C. or more, the rate of elevation in strength was small. It is accordingly apparent that an excellent balance between strength and toughness will be demonstrated with a working temperature of from 50° C. to 200° C. On the other hand, at a room temperature of 20° C. the drawing process was not workable, because the wire snapped.

As will be seen from Table IV, with a formability of 5% as cross-sectional reduction rate, the necking-down and elongation percentages are together low, but when the formability was 10% or more, a necking-down rate of 40% or more and an elongation of 8% or more were obtained. Meanwhile, drawing was not possible with a formability of 35% as cross-sectional reduction rate. It is apparent from these facts that outstanding toughness will be demonstrated by means of a drawing process in which the formability is 10% or more but 30% or less.

The wires produced were of length 1000 times or more their diameter; and with the wires multipass, iterative processing was possible. Furthermore, the average crystal grain size of the present invention examples was in every case 10 μm or less, while the surface roughness $R_z$ was 10 μm or less.

Embodiment 3

Spring-formation was carried out utilizing the wire produced in Embodiments 1 and 2, and the same diameter of extrusion material. Spring-forming work to make springs 40 mm in outside diameter was carried out utilizing the 5.0 mm-diameter wire; and the relationship between whether spring-formation was or was not possible, and the average crystal grain size of and the roughness of the material, were investigated. Adjustment of the average crystal grain size and adjustment of the surface roughness were carried out principally by adjusting the working temperature during the drawing process. The working temperature in the present example was 50 to 200° C. The average crystal grain size was found by magnifying the wire cross-sectional structure under a microscope, measuring the grain size of a number of the crystals within the field of view, and averaging the sizes. The surface roughness was evaluated according to the $R_z$. The results are set forth in Table V.

TABLE V

| Alloy type | | Crystal grain size μm | Surface roughness μm | Spring-forming possible/not poss.: + not: − |
|---|---|---|---|---|
| AZ31 | Present invention | 5.0 | 5.3 | + |
| | | 6.5 | 4.7 | + |

TABLE V-continued

| Alloy type | | Crystal grain size μm | Surface roughness μm | Spring-forming possible/not poss.: + not: − |
|---|---|---|---|---|
| | examples | 7.2 | 6.7 | + |
| | | 7.9 | 6.4 | + |
| | | 8.7 | 8.8 | + |
| | | 9.2 | 7.8 | + |
| | | 9.8 | 8.9 | + |
| | Comp. examples | 28.5 | 18.3 | − |
| | | 29.3 | 12.5 | − |
| AZ61 | Present invention examples | 4.8 | 5.1 | + |
| | | 6.3 | 5.3 | + |
| | | 7.5 | 6.8 | + |
| | | 7.9 | 5.3 | + |
| | | 8.3 | 8.9 | + |
| | | 9.1 | 7.8 | + |
| | | 9.9 | 8.8 | + |
| | Comp. examples | 29.6 | 18.3 | − |
| | | 27.5 | 12.5 | − |

Embodiment 4

Utilizing as a ϕ 6.0 mm extrusion material a magnesium alloy (a material corresponding to ASTM specification AZ61 alloy) containing, in mass %, 6.4% Al, 1.0% Zn and 0.28% Mn, with the remainder being composed of Mg and impurities, a drawing process in which the working temperature was 35° C. and the cross-sectional reduction rate (formability) was 27.8% was implemented on the extrusion material. The heating temperature of a heater set up in front of the wire die was taken to be the working temperature. The speed with which the temperature was elevated to the working temperature was 1 to 10° C./sec, and the wire speed in the drawing process was 5 m/min. Likewise, cooling was conducted by air-blast cooling. The cooling speed was 0.1° C./sec or faster. The resulting characteristics exhibited by the wire obtained were: 460 MPa tensile strength, 15% necking-down rate, and 6% elongation. The wire was annealed for 15 minutes at a temperature of 100 to 400° C.; measurements as to the resulting tensile characteristics are set forth in Table VI.

TABLE VI

| Alloy type | | Annealing temp. ° C. | Tensile strength MPa | Elongation after failure % | Necking-down rate % |
|---|---|---|---|---|---|
| AZ61 | Comp. examples | None | 460 | 6.0 | 15.0 |
| | Present invention examples | 100 | 430 | 25.0 | 45.0 |
| | | 200 | 382 | 22.0 | 48.0 |
| | | 300 | 341 | 23.0 | 40.0 |
| | | 400 | 310 | 20.0 | 35.0 |

As will be understood from reviewing Table VI, although annealing led to somewhat of an accompanying decline in strength, it is apparent that the toughness in terms of elongation and necking-down rate recovered quite substantially. Namely, annealing at 100 to 300° C. after the wiredrawing process is extremely effective in recovering toughness, even as it sustains a tensile strength of 330 MPa or greater. A tensile strength of 300 MPa or greater was obtained even with 400° C. annealing, and sufficient toughness was gained. In particular, performing 100 to 300° C. annealing after the drawing work made it possible to produce wire of outstanding toughness even at a drawing process temperature of less than 50° C.

Embodiment 5

Utilizing as a ϕ 6.0 mm extrusion material a magnesium alloy (a material corresponding to ASTM specification ZK60 alloy) containing, in mass %, 5.5% Zn, and 0.45% Zr, with the remainder being composed of Mg and impurities, a drawing process was conducted on the extrusion material by drawing it through a wire die under a variety of conditions. The heating temperature of a heater set up in front of the wire die was taken to be the working temperature. The speed with which the temperature was elevated to the working temperature was 1 to 10° C./sec, and the wire speed in the drawing process was 5 m/min. Likewise, cooling was conducted by air-blast cooling. The cooling speed in the present invention example was 0.1° C./sec and above. The average crystal grain size was found by magnifying the wire cross-sectional structure under a microscope, measuring the grain size of a number of the crystals within the field of view, and averaging the sizes. The axial residual stress in the wire surface was found by X-ray diffraction. The post-processing wire diameter was 4.84 to 5.85 mm (5.4 mm in a 19% cross-sectional reduction process; 5.85 to 4.84 mm at 5 to 35% cross-sectional reduction rates). In Table VII, the characteristics of wire obtained wherein the working temperature was varied are set forth, while in Table VIII, the characteristics of wire obtained wherein the cross-sectional reduction rate was varied are.

TABLE VII

| Alloy type | | Working temp.° C. | Cross-sectional reduction rate % | Cooling speed ° C./sec | Tensile strength MPa | Elongation after failure % | Necking-down rate % | Crystal grain size μm |
|---|---|---|---|---|---|---|---|---|
| ZK60 | Comp. | | Unprocessed | | 320 | 20.0 | 13.0 | 31.2 |
| | examples | 20 | 19 | 10 | | Unprocessable | | |
| | Present | 50 | 19 | 10 | 479 | 8.5 | 17.9 | 5.0 |
| | invention | 100 | 19 | 10 | 452 | 8.3 | 20.1 | 6.8 |
| | examples | 150 | 19 | 10 | 420 | 9.8 | 25.6 | 6.8 |
| | | 200 | 19 | 10 | 395 | 9.7 | 32.0 | 8.0 |
| | | 250 | 19 | 10 | 374 | 10.5 | 31.2 | 8.6 |
| | | 300 | 19 | 10 | 362 | 11.2 | 35.4 | 9.3 |
| | | 350 | 19 | 10 | 344 | 11.3 | 38.2 | 9.9 |

TABLE VIII

| Alloy type | | Working temp. ° C. | Cross-sectional reduction rate % | Cooling speed ° C./sec | Tensile strength MPa | Elongation after failure % | Necking-down rate % | Crystal grain size μm |
|---|---|---|---|---|---|---|---|---|
| ZK60 | Comp. | | Unprocessed | | 320 | 20.0 | 13.0 | 31.2 |
| | examples | 100 | 5 | 10 | 329 | 9.9 | 14.9 | 18.2 |
| | Present | 100 | 10.5 | 10 | 402 | 9.8 | 21.5 | 6.5 |
| | invention | 100 | 19 | 10 | 452 | 8.3 | 20.1 | 6.8 |
| | examples | 100 | 27 | 10 | 340 | 9.0 | 19.5 | 6.3 |
| | | 100 | 35 | | | Unprocessable | | |

As will be seen from Table VII, the toughness of the extrusion material was a low 13% in terms of necking-down rate. On the other hand, the examples in the present invention, which went through drawing processes at temperatures of 50° C. or more, were 330 MPa or more in strength, evidencing a very significantly enhanced strength. Likewise, they had necking-down rates of 15% or more, and percent-elongations of 6% or more. In addition, with process temperatures of 250° C. or more, the rate of elevation in strength was small. It is accordingly apparent that an excellent strength-toughness balance will be demonstrated with a working temperature of from 50° C. to 200° C. On the other hand, at a room temperature of 20° C. the drawing process was not workable, because the wire snapped.

As will be seen from Table VIII, it is apparent that while with a formability of 5%, the necking-down and elongation values are together low, with a formability of 10% or greater, the elevation in strength is striking. Meanwhile, drawing was not possible with a formability of 35%. This evidences that wire may be produced by means of a drawing process in which the formability is 10% or more but 30% or less.

The wires produced were of length 1000 times or more their diameter; and with the wires multipass, iterative processing was possible. Furthermore, in the present invention the average crystal grain size in every case was 10 μm or less, the surface roughness $R_z$ was 10 μm or less, and the axial residual stress was 80 MPa or less.

Embodiment 6

Spring-formation was carried out utilizing the wire produced in Embodiment 5, and the same diameter of extrusion material. Spring-forming work to make springs 40 mm in outside diameter was carried out utilizing 5.0 mm-gauge wire; and whether spring-formation was or was not possible, and the average crystal grain size of and the roughness of the material, were measured. The surface roughness was evaluated according to the $R_z$. The results are set forth in Table IX.

TABLE IX

| Alloy type | | Crystal grain size μm | Surface roughness μm | Spring-forming possible/not poss.: + not: − |
|---|---|---|---|---|
| ZK60 | Present | 4.8 | 5.0 | + |
| | invention | 6.3 | 6.8 | + |

TABLE IX-continued

| Alloy type | | Crystal grain size μm | Surface roughness μm | Spring-forming possible/not poss.: + not: – |
|---|---|---|---|---|
| | examples | 7.5 | 6.8 | + |
| | | 7.9 | 8.0 | + |
| | | 8.3 | 8.6 | + |
| | | 9.1 | 9.3 | + |
| | | 9.9 | 9.9 | + |
| | Comp. | 30.2 | 19.2 | – |
| | examples | 26.8 | 13.7 | – |

As will be seen from Table IX, it is apparent that while spring-formation with magnesium wire whose average crystal grain size is 10 μm or less, and whose $R_z$ surface roughness is 10 μm or less was possible, but due to the wire snapping while being worked in the other cases, the process was not doable. It is accordingly evident that in the present invention, with magnesium-based alloy wire whose average crystal grain size was 10 μm or less and whose surface roughness $R_z$ was 10 μm or less, spring-formation is possible.

Embodiment 7

Materials corresponding to alloys AZ31, AZ61, AZ91 and ZK60 listed below were prepared as ϕ 6.0 mm extrusion materials. The units for the chemical components are all mass %.

AZ31: containing 3.0% Al, 1.0% Zn and 0.15% Mn; remainder being Mg and impurities.

AZ61: containing 6.4% Al, 1.0% Zn and 0.28% Mn; remainder being Mg and impurities.

AZ91: containing 9.0% Al, 0.7% Zn and 0.1% Mn; remainder being Mg and impurities.

ZK60: containing 5.5% Zn and 0.45% Zr; remainder being Mg and impurities.

Utilizing these extrusion materials, at a working temperature of 100° C. wiredrawing until ϕ 1.2 mm at a formability of 15 to 25%/pass was implemented using a wire die. The heating temperature of a heater set up in front of the wire die was taken to be the working temperature. The speed with which the temperature was elevated to the working temperature was 1 to 10° C./sec, and the wire speed in the drawing process was 5 m/min. Likewise, cooling was conducted by air-blast cooling. The cooling speed was 0.1° C./sec and above. With there being no wire-snapping in the present invention material during the drawing work, lengthy wire could be produced. The wires obtained had lengths 1000 times or more their diameter.

In addition, measurements of out-of-round and surface roughness were made. The out-of-round was the difference between the maximum and minimum values of the diameter in the same sectional plane through the wire. The surface roughness was evaluated according to the $R_z$. The test results are set forth in Table X. These characteristics are also given for the extrusion materials as comparison materials.

TABLE X

| Alloy type | Mfr. tech. | Tensile strength MPa | Elon-gation % | Necking-down rate % | Out-of-round mm | Surface roughness μm |
|---|---|---|---|---|---|---|
| AZ31 | Wire draw. | 340 | 50 | 9 | 0.005 | 4.8 |
| AZ61 | " | 430 | 21 | 9 | 0.005 | 5.2 |
| AZ91 | " | 450 | 18 | 8 | 0.008 | 6.2 |
| ZK60 | " | 480 | 18 | 9 | 0.007 | 4.3 |
| AZ31 | Extrusion | 260 | 35 | 15 | 0.022 | 12.8 |
| AZ61 | " | 285 | 35 | 15 | 0.015 | 11.2 |
| AZ91 | " | 320 | 13 | 9 | 0.018 | 15.2 |
| ZK60 | " | 320 | 13 | 20 | 0.021 | 18.3 |

As indicated in Table X, it is apparent that features of the present invention materials were: tensile strength that was 300 MPa and greater with, moreover, necking-down rate being 15% or greater and elongation being 6% or greater; and furthermore, surface roughness $R_z \leqq 10$ μm.

Embodiment 8

Further to the foregoing embodiment, wires of ϕ 0.8, ϕ 1.6 and ϕ 2.4 mm wire gauge were fabricated, at drawing-work temperatures of 50° C., 150° C. and 200° C. respectively, in the same manner as in Embodiment 7, and evaluations were made in the same way. Confirmed as a result was that each featured tensile strength that was 300 MPa or greater with 15% or greater necking-down rate and 6% or greater elongation besides; and furthermore, out-of-round 0.01 mm or less, and surface roughness $R_z \leqq 10$ μm.

The obtained wires were also put into even coils at 1.0 to 5.0 kg respectively on reels. Wire pulled out from the reels had good flexibility in terms of coiling memory, meaning that excellent welds in manual welding, and MIG, TIG and like automatic welding can be expected from the wire.

Embodiment 9

Utilizing as a ϕ 8.0 mm extrusion material an AZ-31 magnesium alloy, wires were produced by carrying out a drawing process at a 100° C. working temperature until the material was ϕ 4.6 mm (10% or greater single-pass formability; 67% total formability). The heating temperature of a heater set up in front of the wire die was taken to be the working temperature. The speed with which the temperature was elevated to the working temperature was 1 to 10° C./sec, and the wire speed in the drawing process was 2 to 10 m/min. Cooling following the drawing process was carried out by air-blast cooling, and the cooling speed was 0.1° C./sec or more. The obtained wires were heat-treated for 15 minutes at 100° C. to 350° C. Their tensile characteristics are set forth in Table XI. Entered as "present invention examples" therein both are wires whose structure was mixed-grain, and whose average crystal grain size was 5 μm or less.

TABLE XI

| Alloy type | | Heating temp. ° C. | Tensile strength MPa | Elongation after failure % | Necking-down rate % | Crystal grain size μm |
|---|---|---|---|---|---|---|
| AZ31 | Reference | 50 | 423 | 2.0 | 10.2 | 22.5 |
| | examples | 80 | 418 | 4.0 | 14.3 | 21.2 |
| | Present | 150 | 365 | 10.0 | 31.2 | Mixed-grain |
| | invention examples | 200 | 330 | 18.0 | 45.0 | Mixed-grain |
| | | 250 | 310 | 18.0 | 57.5 | 4.0 |
| | | 300 | 300 | 19.0 | 51.3 | 5.0 |
| | Ref. ex. | 350 | 270 | 21.0 | 47.1 | 10.0 |

As will be seen from Table XI, although the strength was high with heat-treating temperatures of 80° C. or less, with the elongation and necking-down rates being low, toughness was lacking. In this instance the crystalline structure was a processed structure, and the average grain size, reflecting the preprocessing grain size, was some 20 μm.

Meanwhile, when the heating temperature was 150° C. or more, although the strength dropped somewhat, recovery in elongation and necking-down rates was remarkable, wherein wire in which a balance was struck between strength and toughness was obtained. In this instance the crystalline structure with the heating temperature being 150° C. and 200° C. turned out to be a mixed-grain structure of crystal grains 3 μm or less average grain size, and crystal grains 15 μm or less (ditto). At 250° C. or more, a structure in which the magnitude of the crystal grains was nearly uniform was exhibited; those average grain sizes are as entered in Table XI. Securing 300 MPa or greater strength with average grain size being 5 μm or less was possible.

Embodiment 10

Wire produced by carrying out a drawing process utilizing as a ϕ 8.0 mm extrusion material an AZ-31 magnesium alloy and varying the total formability by single-pass formabilities of 10% or greater—with the working temperature being 150° C.—were heat-treated 15 minutes at 200° C., and the tensile characteristics of the post-heat-treated materials were evaluated. The heating temperature of a heater set up in front of the wire die was taken to be the working temperature of the drawing process. The speed with which the temperature was elevated to the working temperature was 2 to 5° C./sec, and the wire speed in the drawing process was 2 to 5 m/min. Cooling following the drawing process was carried out by air-blast cooling, and the cooling speed was 0.1° C./sec or more. The results are set forth in Table XII. Entered as "present invention examples" therein are wires whose structure was mixed-grain.

TABLE XII

| Alloy type | | Formability % | Tensile strength MPa | Elongation after failure % | Necking-down rate % | Crystal grain size μm |
|---|---|---|---|---|---|---|
| AZ31 | Ref. ex. | 9.8 | 280 | 9.5 | 41.0 | 18.2 |
| | Pres. | 15.6 | 302 | 18.0 | 47.2 | Mixed-grain |
| | invent. | 23.0 | 305 | 17.0 | 45.9 | Mixed-grain |
| | ex. | 34.0 | 325 | 18.0 | 44.8 | Mixed-grain |
| | | 43.8 | 328 | 19.0 | 47.2 | Mixed-grain |
| | | 66.9 | 330 | 18.0 | 45.0 | Mixed-grain |

As will be understood from reviewing Table XII, although structural control was inadequate with total formability of 10% or less, with (ditto) 15% or more, the structure turned out to be a mixture of crystal grains 3 μm or less average grain size, and crystal grains 15 μm or less (ditto), wherein both high strength and high toughness were managed.

An optical micrograph of the structure of the post-heat-treated wire in which the formability was made 23% is presented in FIG. 1. As is clear from this photograph, it will be understood that the structure proved to be a mixture of crystal grains 3 μm or less average grain size, and crystal grains 15 μm or less (ditto), wherein the surface-area percentage of crystal grains 3 μm or less is approximately 15%. What may be seen from the mixed-grain structures in the present embodiment is that in every case the surface-area percentage of crystal grains 3 μm or less is 10% or more. Likewise, total formability of 30% or more was effective in heightening the strength all the more.

Embodiment 11

Utilizing as a ϕ6.0 mm extrusion material ZK-60 alloy, a drawing process at a 150° C. working temperature until the material was ϕ 5.0 mm (30.6% total formability) was carried out. The heating temperature of a heater set up in front of the wire die was taken to be the working temperature. The speed with which the temperature was elevated to the working temperature was 2 to 5° C./sec, and the wire speed in the drawing process was 2 m/min. Cooling following the drawing process was carried out by air-blast cooling, and the cooling speed was made 0.1° C./sec or more. A 15-min. heating treatment at 100° C. to 350° C. was carried out on the wires after cooling. The tensile characteristics of the post-heat-treated wire are indicated in Table XIII. Entered as "present invention examples" therein both are wires whose structure was mixed-grain, and whose average crystal grain size was 5 μm or less.

TABLE XIII

| Alloy type | | Heating temp. ° C. | Tensile strength MPa | Elongation after failure % | Necking-down rate % | Crystal grain size μm |
|---|---|---|---|---|---|---|
| ZK60 | Reference | 50 | 525 | 3.2 | 8.5 | 17.5 |
| | examples | 80 | 518 | 5.5 | 10.2 | 16.8 |
| | Present | 150 | 455 | 10.0 | 32.2 | Mixed-grain |
| | invention examples | 200 | 445 | 15.5 | 35.5 | Mixed-grain |
| | | 250 | 420 | 17.5 | 33.2 | 3.2 |
| | | 300 | 395 | 16.8 | 34.5 | 4.8 |
| | Ref. ex. | 350 | 360 | 18.9 | 35.5 | 9.7 |

As will be seen from Table XIII, although the strength was high with heat-treating temperatures of 80° C. or less, with the elongation and necking-down rates being low, toughness was lacking. In this instance the crystalline structure was a processed structure, and the grain size, reflecting the pre-processing grain size, was dozens of μm.

Meanwhile, when the heating temperature was 150° C. or more, although the strength dropped somewhat, recovery in elongation and necking-down rates was remarkable, wherein wire in which a balance was struck between strength and toughness was obtained. In this instance the crystalline structure with the heating temperature being 150° C. and 200° C. turned out to be a mixed-grain structure of crystal grains 3 μm or less average grain size, and crystal grains 15 μm or less (ditto). At 250° C. or more, a structure of uniform grain size was exhibited; those grain sizes are as entered in Table XIII. Securing 390 MPa or greater strength with average grain size being 5 μm or less was possible.

Embodiment 12

Utilizing as ϕ 5.0 mm extrusion materials AZ31 alloy, AZ61 alloy and ZK60 alloy, a warm-working process in which the materials were drawn through a wire die until they were ϕ 4.3 mm was carried out. The heating temperature of a heater set up in front of the wire die was taken to be the working temperature. The speed with which the temperature was elevated to the working temperature was 2 to 5° C./sec, and the wire speed in the drawing process was 3 m/min. Cooling following the drawing process was carried out by air-blast cooling, and the cooling speed was made 0.1° C./sec or more. The heating temperatures during the drawing work, and the characteristics of the wire obtained, are set forth in Tables XIV through XVI. The YP ratio and torsion yield ratio $\tau_{0.2}/\tau_{max}$ were evaluated for the wire characteristics. The YP ratio is 0.2% proof stress/tensile strength. The torsion yield ratio of 0.2% offset strength $\tau_{0.2}$ to maximum shear stress $\tau_{max}$ in a torsion test. The inter-chuck distance in the torsion test was made 100 d (d:wire diameter); $\tau_{0.2}$ and $\tau_{max}$ were found from the relationship between the torque and the rotational angle reckoned during the test. The characteristics of the extrusion material as a comparison material are also tabulated and set forth.

TABLE XIV

| Alloy type | | Heating temp. ° C. | Tensile strength MPa | 0.2% Proof stress MPa | YP ratio | $\tau_{max}$ MPa | $\tau_{0.2}$ MPa | $\tau_{0.2}/\tau_{max}$ MPa |
|---|---|---|---|---|---|---|---|---|
| AZ31 | Present | 100 | 345 | 333 | 0.96 | 188 | 136 | 0.72 |
| | invent. | 200 | 331 | 311 | 0.94 | 186 | 133 | 0.72 |

TABLE XIV-continued

| Alloy type | | Heating temp. ° C. | Tensile strength MPa | 0.2% Proof stress MPa | YP ratio | $\tau_{max}$ MPa | $\tau_{0.2}$ MPa | $\tau_{0.2}/\tau_{max}$ MPa |
|---|---|---|---|---|---|---|---|---|
| | ex. | 300 | 309 | 282 | 0.91 | 182 | 115 | 0.63 |
| | Comp. ex. | Extrusion material | 268 | 185 | 0.69 | 166 | 78 | 0.47 |

TABLE XV

| Alloy type | | Heating temp. ° C. | Tensile strength MPa | 0.2% Proof stress MPa | YP ratio | $\tau_{max}$ MPa | $\tau_{0.2}$ MPa | $\tau_{0.2}/\tau_{max}$ MPa |
|---|---|---|---|---|---|---|---|---|
| AZ61 | Present invent. ex. | 100 | 405 | 377 | 0.93 | 221 | 165 | 0.75 |
| | | 200 | 373 | 358 | 0.96 | 210 | 138 | 0.66 |
| | | 300 | 364 | 352 | 0.97 | 214 | 130 | 0.61 |
| | Comp. ex. | Extrusion material | 311 | 222 | 0.71 | 192 | 88 | 0.46 |

TABLE XVI

| Alloy type | | Heating temp. ° C. | Tensile strength MPa | 0.2% Proof stress MPa | YP ratio | $\tau_{max}$ MPa | $\tau_{0.2}$ MPa | $\tau_{0.2}/\tau_{max}$ MPa |
|---|---|---|---|---|---|---|---|---|
| ZK60 | Present invent. ex. | 100 | 376 | 359 | 0.96 | 205 | 147 | 0.72 |
| | | 200 | 373 | 358 | 0.96 | 210 | 138 | 0.66 |
| | | 300 | 364 | 352 | 0.97 | 214 | 130 | 0.61 |
| | Comp. ex. | Extrusion material | 311 | 222 | 0.71 | 192 | 88 | 0.46 |

As will be seen from Tables XIV through XVI, as against YP ratios of 0.7 or so for the extrusion materials, those of the present invention examples in every case were 0.9 or greater, and the 0.2% proof stress values increased to or above the rise in tensile strength.

It will also be understood that the $\tau_{0.2}/\tau_{max}$ ratio in the composition of either of the extrusion materials was less than 0.5, while with the present invention examples higher values of 0.6 or more were shown. These results were the same with wire and rods that are odd form (non-circular) in transverse section.

Embodiment 13

Utilizing as ϕ 5.0 mm extrusion materials AZ31 alloy, AZ61 alloy and ZK60 alloy, a warm-working process in which the materials were drawn through a wire die until they were ϕ 4.3 mm was carried out. The heating temperature of a heater set up in front of the wire die was taken to be the working temperature. The speed with which the temperature was elevated to the working temperature was 5 to 10° C./sec, and the wire speed in the drawing process was 3 m/min. Cooling following the drawing process was carried out by air-blast cooling, and the cooling speed was made 0.1° C./sec or more. A 100° C. to 300° C.×15-min. heating treatment was carried out on the wires after cooling. For the wire characteristics, the YP ratio and the torsion yield ratio $\tau_{0.2}/\tau_{max}$ were evaluated in the same manner as in Embodiment 12. The results are set forth in Tables XVII through XIX. The characteristics of the extrusion material as a comparison material are also tabulated and set forth.

TABLE XVII

| Alloy type | | Heating temp. ° C. | Tensile strength MPa | 0.2% Proof stress MPa | YP ratio | Elongation % | $\tau_{max}$ MPa | $\tau_{0.2}$ MPa | $\tau_{0.2}/\tau_{max}$ MPa |
|---|---|---|---|---|---|---|---|---|---|
| AZ31 | Present invention examples | None | 335 | 310 | 0.93 | 7.5 | 187 | 137 | 0.73 |
| | | 100 | 340 | 328 | 0.96 | 6.0 | 186 | 132 | 0.71 |
| | | 150 | 323 | 303 | 0.94 | 9.0 | 184 | 129 | 0.7 |
| | | 200 | 297 | 257 | 0.87 | 17.0 | 175 | 100 | 0.57 |
| | | 250 | 280 | 210 | 0.75 | 19.0 | 174 | 94 | 0.54 |
| | | 300 | 277 | 209 | 0.75 | 21.0 | 172 | 91 | 0.53 |
| | Comp. ex. | Extrusion material | 268 | 185 | 0.69 | 16.0 | 166 | 78 | 0.47 |

TABLE XVIII

| Alloy type | | Heating temp. ° C. | Tensile strength MPa | 0.2% Proof stress MPa | YP ratio | Elongation % | $\tau_{max}$ MPa | $\tau_{0.2}$ MPa | $\tau_{0.2}/\tau_{max}$ MPa |
|---|---|---|---|---|---|---|---|---|---|
| AZ61 | Present invention examples | None | 398 | 363 | 0.91 | 3.0 | 220 | 158 | 0.72 |
| | | 100 | 393 | 364 | 0.93 | 5.0 | 220 | 154 | 0.7 |
| | | 150 | 375 | 352 | 0.94 | 7.0 | 218 | 150 | 0.69 |
| | | 200 | 370 | 309 | 0.83 | 18.0 | 212 | 119 | 0.56 |
| | | 250 | 354 | 286 | 0.81 | 17.0 | 211 | 114 | 0.54 |
| | | 300 | 329 | 248 | 0.75 | 18.0 | 209 | 107 | 0.51 |
| | Comp. ex. | Extrusion material | 315 | 214 | 0.68 | 15.0 | 195 | 82 | 0.42 |

TABLE XIX

| Alloy type | | Heating temp. ° C. | Tensile strength MPa | 0.2% Proof stress MPa | YP ratio | Elongation % | $\tau_{max}$ MPa | $\tau_{0.2}$ MPa | $\tau_{0.2}/\tau_{max}$ MPa |
|---|---|---|---|---|---|---|---|---|---|
| ZK60 | Present invention examples | None | 371 | 352 | 0.95 | 8.0 | 210 | 153 | 0.73 |
| | | 100 | 369 | 339 | 0.92 | 7.0 | 208 | 146 | 0.7 |
| | | 150 | 355 | 327 | 0.92 | 9.0 | 205 | 139 | 0.68 |
| | | 200 | 350 | 298 | 0.85 | 18.0 | 204 | 116 | 0.57 |
| | | 250 | 347 | 285 | 0.82 | 21.0 | 202 | 111 | 0.55 |
| | | 300 | 345 | 262 | 0.76 | 20.0 | 200 | 104 | 0.52 |
| | Comp. ex. | Extrusion material | 311 | 222 | 0.71 | 18.0 | 192 | 88 | 0.46 |

As will be seen from Tables XVII through XIX, in contrast to the 0.7 YP ratio for the extrusion material, the YP ratios for the present invention examples, on which wiredrawing and heat treatment were performed, were 0.75 or larger. It is apparent that among them, with the present invention examples whose YP ratios were controlled to be 0.75 or more but less than 0.90 the percent elongation was large, while the workability was quite good. If even greater strength is sought, it will be found balanced very well with elongation in the examples whose YP ratio is 0.80 or more but less than 0.90.

Meanwhile, the torsion yield ratio $\tau_{0.2}/\tau_{max}$ was less than 0.5 with the extrusion materials in whichever composition, but with those on which wiredrawing and heat treatment were performed, high values of 0.50 or greater were shown. In cases where, with formability being had in mind, elongation is to be secured, it will be understood that a torsion yield ratio $\tau_{0.2}/\tau_{max}$ of 0.50 or more but less than 0.60 would be preferable.

10° C./sec; the cooling speed was 0.1° C./sec or faster; and the wire speed in the drawing process was 2 m/min. Likewise, the cooling was carried out by air-blast cooling. After that, the filamentous articles obtained underwent a 20-minute heating treatment at a temperature of from 50° C. to 350° C., yielding various wires.

The tensile strength, elongation after failure, necking-down rate, YP ratio, $\tau_{0.2}/\tau_{max}$, and crystal grain size were investigated. The average crystal grain size was found by magnifying the wire cross-sectional structure under a microscope, measuring the grain size of a number of the crystals within the field of view, and averaging the sizes. The results are set forth in Table XX. The tensile strength of the ϕ 5.0 mm extrusion material was 225 MP; its toughness: 38% necking-down rate, 9% elongation; its YP ratio, 0.64; and its $\tau_{0.2}/\tau_{max}$ ratio, 0.55.

TABLE XX

| Alloy type | No. | Heating temp. ° C. | Tensile strength MPa | Elongation after failure % | Necking-down rate % | 0.2% Proof stress MPa | YP ratio | $\tau_{max}$ MPa | $\tau_{0.2}$ MPa | $\tau_{0.2}/\tau_{max}$ MPa | Crystal grain size μm |
|---|---|---|---|---|---|---|---|---|---|---|---|
| AZ10 | 1 | None | 350 | 6.5 | 35.2 | 343 | 0.98 | 193 | 139 | 0.72 | 23.5 |
| | 2 | 50 | 348 | 7.5 | 34.5 | 338 | 0.97 | 195 | 142 | 0.73 | 23.5 |
| | 3 | 100 | 345 | 7.5 | 37.5 | 335 | 0.97 | 193 | 139 | 0.72 | 23.0 |
| | 4 | 150 | 305 | 13.0 | 45.0 | 271 | 0.89 | 189 | 110 | 0.58 | Mixed-grain |
| | 5 | 200 | 290 | 19.0 | 50.2 | 247 | 0.85 | 183 | 102 | 0.56 | 4.2 |
| | 6 | 250 | 285 | 22.5 | 55.2 | 234 | 0.82 | 185 | 104 | 0.56 | 5.0 |
| | 7 | 300 | 265 | 20.0 | 48.0 | 207 | 0.78 | 164 | 87 | 0.53 | 7.5 |
| | 8 | 350 | 255 | 18.0 | 48.0 | 194 | 0.76 | 158 | 82 | 0.52 | 9.2 |

Heating temp.: Indicates post-drawing heating-treatment temperature.
Crystal grain size: Indicates average crystal grain size.

These results indicate the same tendency regardless of the composition. Furthermore, conditions optimal for heat treating are influenced by the wiredrawing formability and heating time, and differ depending on the wiredrawing conditions. These results were moreover the same with wire and rods that are odd form (non-circular) in transverse section.

Embodiment 14

Utilizing as a ϕ 5.0 mm extrusion material an AZ10-alloy magnesium alloy containing, in mass %, 1.2% Al, 0.4% Zn and 0.3% Mn, with the remainder being composed of Mg and impurities, at a 100° C. working temperature a (double-pass) drawing process in which the total cross-sectional reduction rate was 36% was carried out until the material was ϕ 4.0 mm. A wire die was used for the drawing process. As to the working temperature furthermore, a heater was set up in front of the wire die, and the heating temperature of the heater was taken to be the working temperature. The speed with which the temperature was elevated to the working temperature was As is clear from Table XX, the strength of the drawing-worked wire improved significantly compared with the extrusion material. Viewed in terms of mechanical properties following the heat treatment, with heating temperatures of 100° C. or less the wire underwent no major changes in post-drawing characteristics. It is evident that with temperatures of 150° C. or more elongation after failure and necking-down rate rose significantly. The tensile strength, YP ratio, and $\tau_{0.2}/\tau_{max}$ a ratio may have fallen compared with wire draw-worked as it was without being heat-treated, but greatly exceeded the tensile strength, YP ratio, and $\tau_{0.2}/\tau_{max}$ ratio of the original extrusion material. With the rise in tensile strength, YP ratio, and $\tau_{0.2}/\tau_{max}$ ratio lessening if the heat-treating temperature is more than 300° C., preferably a heat-treating temperature of 300° C. or less will be chosen.

It will be understood that the wire obtained in this embodiment proved to have very fine crystal grains in that, as indicated in Table XX, with a heating temperature of 150° C. plus, the crystal grain size was 10 μm or less, and 5 μm or less with a 200 to 250° C. temperature. Likewise, a 150° C. temperature led to a mixed-grain structure of 3 μm-and-under crystal grains, and 15 μm-and-over crystal grains, wherein the surface-area percentage of crystal grains 3 μm or less was 10% or more.

The length of the wires produced was 1000 times or more their diameter, while the surface roughness $R_z$ was 10 μm or less. The axial residual stress in the wire surface, moreover, was found by X-ray diffraction, wherein the said stress was 80 MPa or less. Furthermore, the out-of-round was 0.01 mm or less. The out-of-round was the difference between the maximum and minimum values of the diameter in the same sectional plane through the wire.

Spring-forming work to make springs 35 mm in outside diameter then was carried out at room temperature utilizing the (ϕ 4.0 mm) wire obtained, wherein the present invention wire was formable into springs without any problems.

Embodiment 15

A variety of wires were produced utilizing as a ϕ 5.0 mm extrusion material an AZ10-alloy magnesium-based alloy containing, in mass %, 1.2% Al, 0.4% Zn and 0.3% Mn, with the remainder being composed of Mg and impurities, by draw-working the extrusion material under a variety of conditions. A wire die was used for the drawing process. As to the working temperature furthermore, a heater was set up in front of the wire die, and the heating temperature of the heater was taken to be the working temperature. The speed with which the temperature was elevated to the working temperature was 10° C./sec, and the wire speed in the drawing process was 2 m/min. The characteristics of the obtained wires are set froth in Tables XXI and XXII. The conditions and results in Table XII are for the case where the cross-sectional reduction rate was fixed and the working temperature was varied, and in Table XXII, for the case where the working temperature was fixed and the cross-sectional reduction rate was varied. In the present example, the drawing work was a single pass only, and "cross-sectional reduction rate" herein is the total cross-sectional reduction rate.

TABLE XXI

| Alloy type | No. | Working temp. ° C. | Cross-sectional reduction rate % | Cooling speed ° C./sec | Tensile strength MPa | Elongation after failure % | Necking-down rate % | 0.2% Proof stress MPa | YP ratio | $\tau_{max}$ MPa | $\tau_{0.2}$ MPa | $\tau_{0.2}/\tau_{max}$ MPa |
|---|---|---|---|---|---|---|---|---|---|---|---|---|
| AZ10 | 1-1 | | Unprocessed | | 205 | 9.0 | 38.0 | 131 | 0.64 | 113 | 62 | 0.55 |
| | 1-2 | 20 | 19 | | | | Unprocessable | | | | | |
| | 1-3 | 50 | 19 | 10 | 321 | 7.0 | 35.2 | 315 | 0.98 | 177 | 129 | 0.73 |
| | 1-4 | 100 | 19 | 10 | 310 | 10.0 | 40.0 | 301 | 0.97 | 174 | 123 | 0.71 |
| | 1-5 | 150 | 19 | 10 | 292 | 10.0 | 45.2 | 277 | 0.95 | 166 | 117 | 0.70 |
| | 1-6 | 200 | 19 | 12 | 285 | 10.5 | 42.1 | 268 | 0.94 | 165 | 112 | 0.68 |
| | 1-7 | 250 | 19 | 12 | 271 | 11.0 | 48.2 | 249 | 0.92 | 160 | 104 | 0.65 |
| | 1-8 | 300 | 19 | 15 | 265 | 11.5 | 49.3 | 244 | 0.92 | 159 | 102 | 0.64 |
| | 1-9 | 350 | 19 | 15 | 252 | 11.8 | 42.3 | 229 | 0.91 | 151 | 95 | 0.63 |

TABLE XXII

| Alloy type | No. | Working temp. ° C. | Cross-sectional reduction rate % | Cooling speed ° C./sec | Tensile strength MPa | Elongation after failure % | Necking-down rate % | 0.2% Proof stress MPa | YP ratio | $\tau_{max}$ MPa | $\tau_{0.2}$ MPa | $\tau_{0.2}/\tau_{max}$ MPa |
|---|---|---|---|---|---|---|---|---|---|---|---|---|
| AZ10 | 2-1 | | Unprocessed | | 205 | 9.0 | 35.0 | 131 | 0.64 | 113 | 62 | 0.55 |
| | 2-2 | 100 | 5 | 10 | 235 | 10.5 | 41.5 | 188 | 0.8 | 130 | 75 | 0.58 |
| | 2-3 | 100 | 10.5 | 10 | 260 | 10.5 | 42.5 | 237 | 0.91 | 152 | 97 | 0.64 |
| | 2-4 | 100 | 19 | 10 | 310 | 10.0 | 40.0 | 301 | 0.97 | 174 | 123 | 0.71 |
| | 2-5 | 100 | 27 | 10 | 330 | 10.0 | 40.5 | 321 | 0.97 | 187 | 140 | 0.75 |
| | 2-6 | 100 | 35 | | | | Unprocessable | | | | | |

As will be seen from Table XXI, the tensile strength of the extrusion material was 205 MPa; its toughness: 38% necking-down rate, 9% elongation. On the other hand, Nos. 1-3 through 1-9, which were draw-worked at a temperature of 50° C. or more, had a necking-down rate of 30% or greater, and an elongation percentage of 6% or greater. Moreover, it is evident that these test materials have a high, 250 MPa or greater tensile strength, 0.90 or greater YP ratio, and 0.60 or greater $\tau_{0.2}/\tau_{max}$ ratio, and that in them improved strength without appreciably degraded toughness was achieved. Nos. 1-4 through 1-9 especially, which were draw-worked at a temperature of 100° C. or more, had a necking-down rate of 40% or greater, and an elongation percentage of 10% or greater, wherein in terms of toughness they were particularly outstanding. In contrast, the rise in tensile strength lessened if the draw-working temperature was more than 300° C.; and No. 1-2, which was draw-worked at a room temperature of 20° C., was unprocessable because the wire snapped. Accordingly, with a working temperature of from 50° C. to 300° C. (preferably from 100° C. to 300° C.), a superb strength-toughness balance will be demonstrated.

As will be seen from Table XXII, with No. 2-2, whose formability was 5%, the percentage rise in tensile strength, YP ratio, and $\tau_{0.2}/\tau_{max}$ ratio was small; but the tensile strength, YP ratio, and $\tau_{0.2}/\tau_{max}$ ratio turned out to be large if the formability was 10% or greater. Meanwhile, with No. 2-6, whose formability was 35%, drawing work was impossible. It will be understood from these facts that a drawing process in which the formability is 10% or more, 30% or less will bring out excellent characteristics—a high tensile strength of 250 MPa or greater, a YP ratio of 0.9 or greater, and $\tau_{0.2}/\tau_{max}$ ratio of 0.60 or greater—without sacrificing toughness.

The obtained wires in either Table XXI or Table XXII were of length 1000 times or more their diameter, and were capable of being repetitively worked in multipass drawing. The surface roughness $R_z$, moreover, was 10 μm or less. The axial residual stress in the wire surface was found by X-ray diffraction, wherein the said stress was 80 MPa or less. Furthermore, the out-of-round was 0.01 mm or less. The out-of-round was the difference between the maximum and minimum values of the diameter in the same sectional plane through the wire.

Spring-forming work to make springs 40 mm in outside diameter then was carried out at room temperature utilizing the wire obtained, wherein the present invention wire was formable into springs without any problems.

Embodiment 16

Utilizing as ϕ 5.0 mm extrusion materials an AS41 magnesium alloy containing, in mass %, 4.2% Al, 0.50% Mn and 1.1% Si, with the remainder being composed of Mg and impurities, and an AM60 magnesium alloy containing 6.1% Al and 0.44% Mn, with the remainder being composed of Mg and impurities, a process in which the materials were drawn at a 19% cross-sectional reduction rate through a wire die until they were ϕ 4.5 mm was carried out. The process conditions therein and the characteristics of the wire produced are set forth in Table XXIII.

TABLE XXIII

| Alloy type | | Working temp. ° C. | Cross-sectional reduction rate % | Cooling speed ° C./sec | Tensile strength MPa | 0.2% Proof stress MPa | YP ratio | Elongation after failure % | Necking-down rate % |
|---|---|---|---|---|---|---|---|---|---|
| AS41 | Comp. | | Unprocessed | | 259 | 151 | 0.58 | 9.5 | 19.5 |
| | examples | 20 | 19 | 10 | | | Unprocessable | | |
| | Pres. invent. ex. | 150 | 19 | 10 | 365 | 335 | 0.92 | 9.0 | 35.3 |
| AM60 | Comp. | | Unprocessed | | 265 | 160 | 0.60 | 6.0 | 19.5 |
| | examples | 20 | 19 | 10 | | | Unprocessable | | |
| | Pres. invent. ex. | 150 | 19 | 10 | 372 | 344 | 0.92 | 8.0 | 32.5 |

As will be seen from Table XXIII, the tensile strength of the AS41-alloy extrusion material was 259 MPa, and the 0.2% proof stress, 151 MPa; while the YP ratio was a low 0.58. Furthermore, necking-down rate was 19.5%, and elongation, 9.5%.

The tensile strength of the AM60-alloy extrusion material was 265 MPa, and the 0.2% proof stress, 160 MPa; while the YP ratio was a low 0.60.

On the other hand, the AS41 alloy and the AM60 alloy that were heated to a temperature of 150° C. and underwent the drawing process together had necking-down rates of 30% or more and elongation percentages of 6% or more, and had high tensile strengths of 300 MPa or more, and YP ratios of 0.9 or more, wherein it is evident that the strength could be improved without appreciably sacrificing toughness. Meanwhile, the drawing process at a room temperature of 20° C. was unworkable due to the wire snapping.

Embodiment 17

Utilizing as ϕ 5.0 mm extrusion materials an AS41 magnesium alloy containing, in mass %, 4.2% Al, 0.50% Mn and 1.1% Si, with the remainder being composed of Mg and impurities, and an AM60 magnesium alloy containing 6.1% Al and 0.44% Mn, with the remainder being composed of Mg and impurities, a process in which the materials were drawn at a 19% cross-sectional reduction rate through a wire die until they were ϕ 4.5 mm was carried out at a working temperature of 150° C. The cooling speed following the process was 10°C./sec. The wires obtained in this instance were heated for 15 minutes at 80° C. and 200° C., and the room-temperature tensile characteristics and crystal grain size were evaluated. The results are set forth in Table XXIV.

TABLE XXIV

| Alloy type | | Working temp. ° C. | Tensile strength MPa | 0.2% Pf. Str. MPa | YP ratio | Elong. % | Necking-down rate % | Crystal grain size μm |
|---|---|---|---|---|---|---|---|---|
| AS41 | Comp. ex. | None | 365 | 335 | 0.92 | 9.0 | 35.3 | 20.5 |
| | | 80 | 363 | 332 | 0.91 | 9.0 | 35.5 | 20.3 |
| | Pres. inv. ex. | 200 | 330 | 283 | 0.86 | 18.5 | 48.2 | 3.5 |
| | Comp. ex. | Extrusion material | 259 | 151 | 0.58 | 9.5 | 19.5 | 21.5 |
| AM60 | Comp. ex. | None | 372 | 344 | 0.92 | 8.0 | 32.5 | 19.6 |
| | | 80 | 370 | 335 | 0.91 | 9.0 | 33.5 | 20.2 |
| | Pres. inv. ex. | 200 | 329 | 286 | 0.87 | 17.5 | 49.5 | 3.8 |
| | Comp. ex. | Extrusion material | 265 | 160 | 0.60 | 6.0 | 19.5 | 19.5 |

The tensile strength, 0.2% proof stress, and YP ratio improved significantly following the wiredrawing process. Viewed in terms of mechanical properties, with a working temperature of 80° C. the post-drawn, heat-treated material underwent no major changes in post-drawing characteristics. It is evident that with a temperature of 200° C., elongation after failure and necking-down rate rose significantly. The tensile strength, 0.2% proof stress, and YP ratio may have fallen compared with as-drawn wire material, but greatly exceeded the tensile strength, 0.2% proof stress, and YP ratio of the original extrusion material.

As indicated in Table XXIV, the crystal grain size obtained in this embodiment with a heating temperature of 200° C. was 5 μm or less, in very fine crystal grains. Furthermore, the length of the wires produced was 1000 times or more their diameter; while the surface roughness $R_z$ was 10 μm or less, the axial residual stress was 80 MPa or less, and the out-of-round was 0.01 mm or less.

In addition, spring-forming work to make springs 40 mm in outside diameter was carried out at room temperature utilizing the (ϕ 4.5 mm) wire obtained, wherein the present invention wire was formable into springs without any problems.

Embodiment 18

A process was carried out in which an EZ33 magnesium-alloy casting material containing, in mass %, 2.5% Zn, 0.6% Zr, and 2.9% RE, with the remainder being composed of Mg and impurities, was by hot-casting rendered into a ϕ 5.0 mm rod material, which was drawn at a 19% cross-sectional reduction rate through a wire die until it was ϕ 4.5 mm. The process conditions therein and the characteristics of the wire produced are set forth in Table XXV. Here, didymium was used as the RE.

TABLE XXV

| Alloy type | | Working temp. ° C. | Cross-sectional reduction rate % | Cooling speed ° C./sec | Tensile strength MPa | 0.2% Proof stress MPa | YP ratio | Elongation after failure % | Necking-down rate % |
|---|---|---|---|---|---|---|---|---|---|
| EZ33 | Comp. examples | | Unprocessed | | 180 | 121 | 0.67 | 4.0 | 15.2 |
| | | 20 | 19 | 10 | | | Unprocessable | | |
| | Present invent. ex. | 150 | 19 | 10 | 253 | 229 | 0.91 | 6.0 | 30.5 |

As will be seen from Table XXV, the tensile strength of the EZ33-alloy extrusion material was 180 MPa, and the 0.2% proof stress, 121 MPa; while the YP ratio was a low 0.67. Furthermore, necking-down rate was 15.2%, and elongation, 4.0%.

On the other hand, the material that was heated to a temperature of 150° C. and underwent the drawing process had a necking-down rate of over 30% and an elongation percentage of 6% strong, and had a high tensile strength of over 220 MPa, and a YP ratio of over 0.9, wherein it is evident that the strength could be improved without appreciably sacrificing toughness. Meanwhile, the drawing process at a room temperature of 20° C. was unworkable due to the wire snapping.

Embodiment 19

A process was carried out in which an EZ33 magnesium-alloy casting material containing, in mass %, 2.5% Zn, 0.6% Zr, and 2.9% RE, with the remainder being composed of Mg and impurities, was by hot-casting rendered into a ϕ 5.0 mm rod material, which was drawn at a 19% cross-sectional reduction rate through a wire die until it was ϕ 4.5 mm. The cooling speed following this process was 10° C./sec or more. The wire obtained in this instance was heated for 15 minutes at 80° C. and 200° C., and the room-temperature tensile characteristics and crystal grain size were evaluated. The results are set forth in Table XXVI. Here, didymium was used as the RE.

TABLE XXVI

| Alloy type | | Working temp. ° C. | Tensile strength MPa | 0.2% Pf. str. MPa | YP ratio | Elong. % | Necking-down rate % | Crystal grain size μm |
|---|---|---|---|---|---|---|---|---|
| EZ33 | Comp. ex. | None | 253 | 229 | 0.91 | 6.0 | 30.5 | 23.4 |
| | | 80 | 251 | 226 | 0.90 | 7.0 | 31.2 | 21.6 |
| | Pres. inv. ex. | 200 | 225 | 195 | 0.87 | 16.5 | 42.3 | 4.3 |
| | Comp. ex. | Casting + cast. mtr. | 180 | 121 | 0.67 | 4.0 | 15.2 | 22.5 |

The tensile strength, 0.2% proof stress, and YP ratio improved significantly following the wiredrawing process. Viewed in terms of mechanical properties, with a working temperature of 80° C. the post-drawn, heat-treated material underwent no major changes in post-drawing characteristics. It is evident that with a temperature of 200° C., elongation after failure and necking-down rate rose significantly. The tensile strength, 0.2% proof stress, and YP ratio may have fallen compared with as-drawn wire material, but greatly exceeded the tensile strength, 0.2% proof stress, and YP ratio of the original extrusion material.

As indicated in Table XXVI, the crystal grain size obtained in this embodiment with a heating temperature of 200° C. was 5 μm or less, in very fine crystal grains. Furthermore, the length of the wire produced was 1000 times or more its diameter; while the surface roughness $R_z$ was 10 μm or less, the axial residual stress was 80 MPa or less, and the out-of-round was 0.01 mm or less.

Embodiment 20

Utilizing as a ϕ 5.0 mm extrusion material an AS21 magnesium alloy containing, in mass %, 1.9% Al, 0.45% Mn and 1.0% Si, with the remainder being composed of Mg and impurities, a process in which the material was drawn at a 19% cross-sectional reduction rate through a wire die until it was 4.5 mm was carried out. The process conditions therein and the characteristics of the wire produced are set forth in Table XXVII.

As will be seen from Table XXVII, the tensile strength of the AS21-alloy extrusion material was 215 MPa, and the 0.2% proof stress, 141 MPa; while the YP ratio was a low 0.66.

On the other hand, the material that was heated to a temperature of 150° C. and underwent the drawing process had a necking-down rate of over 40% and an elongation percentage of over 6%, and had a high tensile strength of over 250 MPa, and a YP ratio of over 0.9, wherein it is evident that the strength could be improved without appreciably sacrificing toughness. Meanwhile, the drawing process at a room temperature of 20° C. was unworkable due to the wire snapping.

Furthermore, the length of the wire produced was 1000 times or more its diameter; while the surface roughness $R_z$ was 10 μm or less, the axial residual stress was 80 MPa or less, and the out-of-round was 0.01 mm or less. In addition, spring-forming work to make springs 40 mm in outside diameter was carried out at room temperature utilizing the (ϕ 4.5) mm wire obtained, wherein the present invention wire was formable into springs without any problems.

Embodiment 21

Utilizing as a ϕ 5.0 mm extrusion material an AS21 magnesium alloy containing, in mass %, 1.9% Al, 0.45% Mn and 1.0% Si, with the remainder being composed of Mg and impurities, a process in which the material was drawn at a 19% cross-sectional reduction rate through a wire die until it was ϕ 4.5 mm was carried out a working temperature of 150° C. The cooling speed following the process was 10° C./sec. The wires obtained in this instance were heated for 15 minutes at 80° C. and 200° C., and the room-temperature tensile characteristics and crystal grain size were evaluated. The results are set forth in Table XXVIII.

TABLE XXVII

| Alloy type | | Working temp. ° C. | Cross-sectional reduction rate % | Cooling speed ° C./sec | Tensile strength MPa | 0.2% Proof stress MPa | YP ratio | Elongation after failure % | Necking-down rate % |
|---|---|---|---|---|---|---|---|---|---|
| AS21 | Comp. examples | | Unprocessed | | 215 | 141 | 0.66 | 10.0 | 35.5 |
| | | 20 | 19 | 10 | | | Unprocessable | | |
| | Present invent. ex. | 150 | 19 | 10 | 325 | 295 | 0.91 | 9.0 | 45.1 |

TABLE XXVIII

| Alloy type | | Working temp. ° C. | Tensile strength MPa | 0.2% Pf. str. MPa | YP ratio | Elong. % | Necking-down rate % | Crystal grain size μm |
|---|---|---|---|---|---|---|---|---|
| AS21 | Comp. ex. | None | 325 | 295 | 0.91 | 9.0 | 45.1 | 22.1 |
| | | 80 | 322 | 293 | 0.91 | 9.5 | 46.2 | 20.5 |
| | Pres. inv. ex. | 200 | 303 | 263 | 0.87 | 18.0 | 52.5 | 3.8 |
| | Comp. ex. | Extrusion mtr. | 215 | 141 | 0.66 | 10.0 | 35.5 | 23.4 |

The tensile strength, 0.2% proof stress, and YP ratio improved significantly following the wiredrawing process. Viewed in terms of mechanical properties, with a working temperature of 80° C. the post-drawn, heat-treated material underwent no major changes in post-drawing characteristics. It is evident that with a temperature of 200° C., elongation after failure and necking-down rate rose significantly. The tensile strength, 0.2% proof stress, and YP ratio may have fallen compared with as-drawn wire material, but greatly exceeded the tensile strength, 0.2% proof stress, and YP ratio of the original extrusion material.

As indicated in Table XXVIII, the crystal grain size obtained in this embodiment with a heating temperature of 200° C. was 5 μm or less, in very fine crystal grains. Furthermore, the length of the wire produced was 1000 times or more its diameter; while the surface roughness $R_z$ was 10 μm or less, the axial residual stress was 80 MPa or less, and the out-of-round was 0.01 mm or less.

In addition, spring-forming work to make springs 40 mm in outside diameter was carried out at room temperature utilizing the (ϕ 4.5) mm wire obtained, wherein the present invention wire was formable into springs without any problems.

Embodiment 22

An AZ31-alloy, ϕ 5.0 mm extrusion material was prepared, and at a 100° C. working temperature a (double-pass) drawing process in which the cross-sectional reduction rate was 36% was carried out on the material until it was ϕ 4.0 mm. The cooling speed following the drawing process was 10° C./sec. After that, the material underwent a 60-minute heating treatment at a temperature of from 100° C. to 350° C., yielding various wires. The rotating-bending fatigue strength of the wires was then evaluated with a Nakamura rotating-bending fatigue tester. In the fatigue test, $10^7$ cycles were run. Evaluations of the average crystal grain size and axial residual stress of the samples were also made at the same time. The results are set forth in Table XXIX.

TABLE XXIX

| Alloy type | Heating temp. ° C. | Fatigue strength MPa | Avg. crystal grain size μm | Residual stress MPa |
|---|---|---|---|---|
| AZ31 | 100 | 80 | — | 98 |
| | 150 | 110 | 2.2 | 6 |
| | 200 | 105 | 2.8 | −1 |
| | 250 | 105 | 3.3 | 0 |
| | 300 | 95 | 6.5 | 2 |
| | 350 | 95 | 12.2 | −3 |

As is clear from Table XXIX, heat treatment at 150° C. or more, but 250° C. or less brought the fatigue strength to a maximum 105 MPa or greater. The average crystal grain size in this instance proved to be 4 μm or less; the axial residual stress, 10 MPa or less.

In addition, ϕ 5.0 mm extrusion materials were prepared from AZ61 alloy, AS41 alloy, AM60 alloy and ZK60 alloy, and evaluated in the same manner. The results are set forth in Tables XXX through XXXIII.

TABLE XXX

| Alloy type | Heating temp. ° C. | Fatigue strength MPa | Avg. crystal grain size μm | Residual stress MPa |
|---|---|---|---|---|
| AZ61 | 100 | 80 | — | 92 |
| | 150 | 120 | 2.1 | 5 |
| | 200 | 115 | 2.9 | 3 |
| | 250 | 115 | 3.1 | −3 |
| | 300 | 105 | 5.9 | 2 |
| | 350 | 105 | 9.9 | −1 |

TABLE XXXI

| Alloy type | Heating temp. ° C. | Fatigue strength MPa | Avg. crystal grain size μm | Residual stress MPa |
|---|---|---|---|---|
| AS41 | 100 | 80 | — | 95 |
| | 150 | 115 | 2.3 | 6 |
| | 200 | 110 | 2.5 | −2 |
| | 250 | 110 | 3.4 | 0 |
| | 300 | 100 | 6.2 | 1 |
| | 350 | 100 | 10.2 | −1 |

TABLE XXXII

| Alloy type | Heating temp. ° C. | Fatigue strength MPa | Avg. crystal grain size μm | Residual stress MPa |
|---|---|---|---|---|
| AM60 | 100 | 80 | — | 96 |
| | 150 | 115 | 2.0 | 5 |
| | 200 | 110 | 2.3 | 3 |
| | 250 | 110 | 3.2 | −1 |
| | 300 | 100 | 6.1 | −2 |
| | 350 | 100 | 10.5 | 0 |

TABLE XXXIII

| Alloy type | Heating temp. ° C. | Fatigue strength MPa | Avg. crystal grain size μm | Residual stress MPa |
|---|---|---|---|---|
| ZK60 | 100 | 80 | — | 96 |
| | 150 | 120 | 2.2 | 6 |
| | 200 | 115 | 2.7 | 2 |
| | 250 | 115 | 3.3 | 0 |
| | 300 | 105 | 6.2 | 1 |
| | 350 | 105 | 9.7 | −1 |

With whichever of the alloy systems, the combination of the drawing process with the subsequent heat-treating process produced a fatigue strength of 105 MPa or greater; and heat treatment at 150° C. or more, but 250° C. or less brought the fatigue strength to a maximum. Furthermore, the average crystal grain size proved to be 4 μm or less; the axial residual stress, 10 MPa or less.

Industrial Applicability

As explained in the foregoing, a wire manufacturing method according to the present invention enables drawing work on magnesium alloys that conventionally had been problematic, and lends itself to producing magnesium-based alloy wire excelling in strength and toughness.

What is more, being highly tough, magnesium-based alloy wire in the present invention facilitates subsequent forming work—spring-forming to begin with—and is effective as a lightweight material excelling in toughness and relative strength.

Accordingly, efficacious applications can be expected from the wire in reinforcing frames for MD players, CD players, mobile telephones, etc., and employed in suitcase frames; and additionally in lightweight springs, and furthermore in lengthy welding wire employable in automatic welders, etc., and in screws and the like.

The invention claimed is:

1. Magnesium-based alloy wire of composition containing, in mass %, 0.1 to 12.0% Al, and 0.1 to 1.0% Mn; the magnesium-based alloy wire being manufactured by a procedure including a drawing process of drawing a parent material of said composition at a controlled temperature to work the parent material into wire form so as to impact the following properties to the magnesium-based alloy wire:

a length L of 1000 d or more, where d is its diameter;

a tensile strength of 250 MPa or more;

a necking-down rate of 15% or more;

a elongation of 6% or more;

a crystal grain size of said composition of between 3.5 μm and 10 μm inclusive; and a surface roughness of $R_z \leqq 10$ μm.

* * * * *

UNITED STATES PATENT AND TRADEMARK OFFICE

CERTIFICATE OF CORRECTION

PATENT NO. : 8,308,878 B2
APPLICATION NO. : 10/479433
DATED : November 13, 2012
INVENTOR(S) : Yukihiro Oishi and Nozumu Kawabe It is certified that error appears in the above-identified patent and that said Letters Patent is hereby corrected as shown below:

On the title page, at item (54), and in the specification, Column 1, Line 1, title:
"MAGNESIUM-BASED ALLOY WIRE AND METHOD OF ITS MANUFACTURE"
should read

--MAGNESIUM BASE ALLOY WIRE--.

On the title page, at item (73) beside the heading Assignees, "Sumitomo (SEI) Steel Wire Corp., Osaka (JP)"
should read --Sumitomo (SEI) Steel Wire Corp., Hyogo (JP)--.

In the Claims:

Column 34, Line 11, Claim 1, "so as to impact the following properties" should read --so as to impart the following properties--.

Signed and Sealed this
Thirtieth Day of April, 2013

Teresa Stanek Rea
*Acting Director of the United States Patent and Trademark Office*